United States Patent [19]

Kallio

[11] Patent Number: 4,519,610

[45] Date of Patent: May 28, 1985

[54] SIMULATED BASEBALL GAME

[76] Inventor: Leo W. Kallio, 71 Windsor St., Worcester, Mass. 01605

[21] Appl. No.: 522,481

[22] Filed: Aug. 12, 1983

[51] Int. Cl.[3] ..... A63F 7/20; A63F 7/30; A63F 7/36

[52] U.S. Cl. ..... 273/89

[58] Field of Search ..... 273/89, 90, 119 A, 120 A, 273/121 A, 122 A, 123 A, 124 A, 125 A

[56] References Cited

U.S. PATENT DOCUMENTS

| | | | |
|---|---|---|---|
| 1,122,141 | 12/1914 | McIlroy | 273/89 |
| 1,570,875 | 1/1926 | Cartee | 273/89 |
| 1,630,869 | 5/1927 | Steinmetz | 273/89 |
| 1,642,093 | 9/1927 | Stewart | 273/89 |
| 1,703,009 | 2/1929 | Kiesling | 273/89 |
| 1,795,801 | 3/1931 | Sechler | 273/89 |
| 1,896,684 | 2/1933 | Cutting et al. | 273/89 |
| 1,942,429 | 1/1934 | Jacobs | 273/89 |
| 2,003,349 | 6/1935 | Dumble | 273/121 A X |
| 2,073,132 | 3/1937 | Williams | 273/121 A |
| 2,161,129 | 6/1939 | Brook | 273/89 |
| 2,749,122 | 6/1956 | Barrett | 273/89 |
| 3,358,997 | 12/1967 | Belz | 273/89 |
| 3,705,723 | 12/1972 | Eissler | 273/89 |

*Primary Examiner*—Paul E. Shapiro

*Attorney, Agent, or Firm*—Cesari and McKenna

[57] ABSTRACT

A baseball board game for two or more players includes a simulated baseball playing field, a manually controlled pitching mechanism to pitch the ball across a home plate area, a catching receptacle for designating whether a particular pitched ball is a ball or a strike, a manually operated bat for contacting the pitched ball and directing it to one of a plurality of pockets located around the perimeter of the playing surface. The various pockets are assigned different designations corresponding to hits and outs to the various field positions in an actual game of baseball. The pocket designations are assigned according to directional constraints, hit-to-out probability and the frequency of hitting to each pocket in order to produce a simulated game that closely resembles the actual game of baseball. The game also signals whether a player has swung through at a particular pitched ball and the game may be operated in a base-stealing mode to further add to the interest and excitement of the contest.

4 Claims, 4 Drawing Figures

SIMULATED BASEBALL GAME

This invention relates to an electromechanical board game. It relates more particularly to a simulated baseball game designed to be played by players on opposing sides.

BACKGROUND OF THE INVENTION

Numerous board games have been developed over the years which simulate the game of baseball. In one such game of which we are aware, a baseball playing field is depicted on the game board. The game is designed for two players, one of which is at bat and the other of which is in the field. The two players have spinners, with the indicia on the in-bat spinner indicating various hit possibilities and the in-the-field spinner showing various out possibilities that occur in a conventional game of baseball. The player at bat spins his spinner and receives a strike, ball, foul, or hits the ball depending upon where the spinner pointer stops. The player in the field then spins his spinner to determine whether the "hit" ball is caught, dropped, etc. Various game pieces are moved around the simulated baseball diamond to represent players on base. A similar prior simulated baseball game utilizes dice instead of spinners to designate the various play possibilities during the game.

The main drawback of those types of simulated baseball games lies in the failure of the games to represent or truly simulate the actual playing conditions of the game of baseball. That is, the spinning of spinners and the throwing of dice bear no relation skillwise to the pitching or batting of a ball. Furthermore, those prior games do not reproduce all of the playing situations and possibilities commonly found in a typical baseball game.

There are some prior simulated baseball games in which a miniature ball is actually pitched to the batter. In other words, the player in the field operates a pitching mechanism which projects a small ball toward home plate. The player at bat manipulates a batting device at home plate and tries to hit the pitched ball. The game board has various holes or pockets over its playing area into which a hit ball can drop to represent various out and hit possibilities. Balls and strikes are determined by the pitched ball missing a designated strike zone and by the batter missing the pitched ball.

That type of game has definite advantages over the games using spinners and dice because the outcome of the game is determined somewhat by the skills of the two players, rather than simply by the laws of chance. Even so, however, they do not even approach the realism of an actual baseball game because they do not offer all of the game options and possibilities that contribute to an exciting contest. Moreover, the various hit, out, double play, foul, etc. plays that are presented by these prior games do not reflect the actual statistical occurrence of those events or plays in a typical baseball game. Thus, while those prior games are denominated simulated base ball games, they do not, in practice, realistically reproduce a typical baseball game.

Moreover, the prior games of that type of which we are aware are not particularly convenient to use by the players and it is often difficult for the players to keep track of the status of the game.

SUMMARY OF THE INVENTION

Accordingly, it is an object of the present invention to provide an improved simulated baseball game.

Another object of the invention is to provide a simulated baseball game which requires the superior players to have more or less the same hand/eye coordination required in the actual game of baseball.

A further object of the invention is to provide a simulated baseball game which is especially easy for the players to use.

Still another object of the invention is to provide a baseball board game which realistically simulates an actual game of baseball.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

Briefly, the present game includes a relatively large, flat housing whose upper surface defines a baseball playing field, including the usual baseball diamond and outfields. Various electrical and mechanical components of the game to be described are positioned on the playing surface and within the housing.

The game includes a mechanical pitching mechanism on the playing surface by which the player in the field pitches a small ball along the playing surface and across a home plate area of the baseball diamond inscribed on the playing surface. The player at bat tries to hit the pitched ball by manipulating a miniature bat pivotally mounted to the playing surface adjacent the home plate area. If the player at bat does not make contact with the pitched ball either because he fails to swing the bat or does swing the bat, but misses the ball, the pitched ball is trapped in one of a plurality of ball-receiving pockets located behind home plate which determines whether that pitch was a strike, a ball or a wild pitch.

If, on the other hand, the player swinging the bat does make contact with the pitched ball, the ball is batted across the playing field and is trapped in one of a plurality of ball-receiving pockets located around the periphery of the outfield. These pockets have various designations corresponding to the various possibilities that exist in the usual game of baseball for a ball that is hit by the batter, including a foul ball, a single-, double- or triple-hit to the infield or outfield, a home run, as well as the usual out possibilities including double- and triple-play outs to the infield or outfield. Thus, the outfield pocket to which the ball is hit determines the fate of the player at bat.

One of the features of the present game concerns the arrangement of these designated pockets so that they result in a game scenario which closely resembles the play during an actual baseball game. That is, the frequencies of occurrence of the balls, strikes, outs, fouls and hits to the various locations on the playing field of this game follow closely the frequencies of occurrence of those situations in a typical baseball game. Therefore, the present game captures much of the excitement of the real game.

The present game includes signal lamps at the various bases and player locations on the playing field. Also the various pockets behind home plate and around the outfield contain switches connected in circuit with those signal lamps. Resultantly, when a ball is received in a particular pocket, the switch associated with that pocket is closed thereby illuminating a signal lamp corresponding to that pocket which apprises the players visually of the fate of each pitched ball. For example, if a pitched ball is not swung at by the batter, that ball will become trapped in either a "ball" pocket or a "strike" pocket or a "wild pitch" pocket behind home plate and an appropriate lamp is lit which signals that that ball was a ball, strike or a wild pitch. The game also includes provision for accumulating such balls and strikes so that the players know when a batter has struck out or deserves a walk to first base. Further, the game even detects when the batter has swung through at the ball, i.e., broken his wrist, so as to deserve a swinging strike.

As a further example, when a ball is hit to a pocket designated "hit to third base", a switch associated with that pocket is closed which turns on a white light at the third base location indicating that the batter has hit a single to third base. On the other hand, if the batted ball is trapped in a pocket designated "out at third base", a different indication, namely a red light, is turned on at that location signaling the out and the "man on base" light at first base is not turned on.

Similar hit and out lamps located at the various player positions on the infield and outfield signal hits or outs at those locations, depending upon which pockets the ball goes into when hit by the batter. The designated ball-receiving pockets include most, if not all, of the possibilities in an actual ball game including doubles, triples, home runs, foul balls, etc.

After each hit is signaled, the player at bat turns on the "man on base" signal at the appropriate base, e.g., after a double is signaled, the "on base" light at second base is turned on; after a triple, the "on base" light at third base is turned on, and so on. Obviously also, if a man is already on base and the next batter gets a hit, the further advance of the man on base is signaled by the player at bat turning on the light at the base to which the man on base advances. The rules of the game call for the man on base to advance the same number of bases that a player typically would advance in an actual baseball game. Some of the outfield pockets are even labeled for a double play situation so that when the ball is received in one of those pockets, the most advanced runner on base and the batter are called out.

Once the fate of each pitched ball has been signaled, the ball can be returned automatically to the pitching location in preparation for the next pitch.

A preferred embodiment of my game can also be operated in a base-stealing mode whereby the player at bat actuates a switch which automatically changes the designations of some of the ball-receiving pockets so that they indicate that a player on base has stolen the next base or has been caught off base and is thus out. The stolen base feature is superimposed on the normal fielding options available and thus further increases the number of play possibilities available to the batter. Thus, it is a feature of the invention that the arrangement of the designated pockets and the options available to the players produce a simulated game in which the occurrences of playing possibilities and events closely follow those that occur in an actual baseball game so that the excitement generated by the board game approximates that produced by the real thing.

Despite the fact that the present game has many, if not all, of the complexities of the actual game of baseball, the game is easy to operate and its rules are simple so that the game can be played by young children as well as adults. Consequently, it should find wide acceptance in the marketplace and prove to be a source of enjoyment to many.

BRIEF DESCRIPTION OF THE DRAWINGS

For a fuller understanding of the nature and objects of the invention, reference should be had to the following detailed description, taken in connection with the accompanying drawings, in which.

DESCRIPTION OF THE PREFERRED EMBODIMENT

Figure 1:
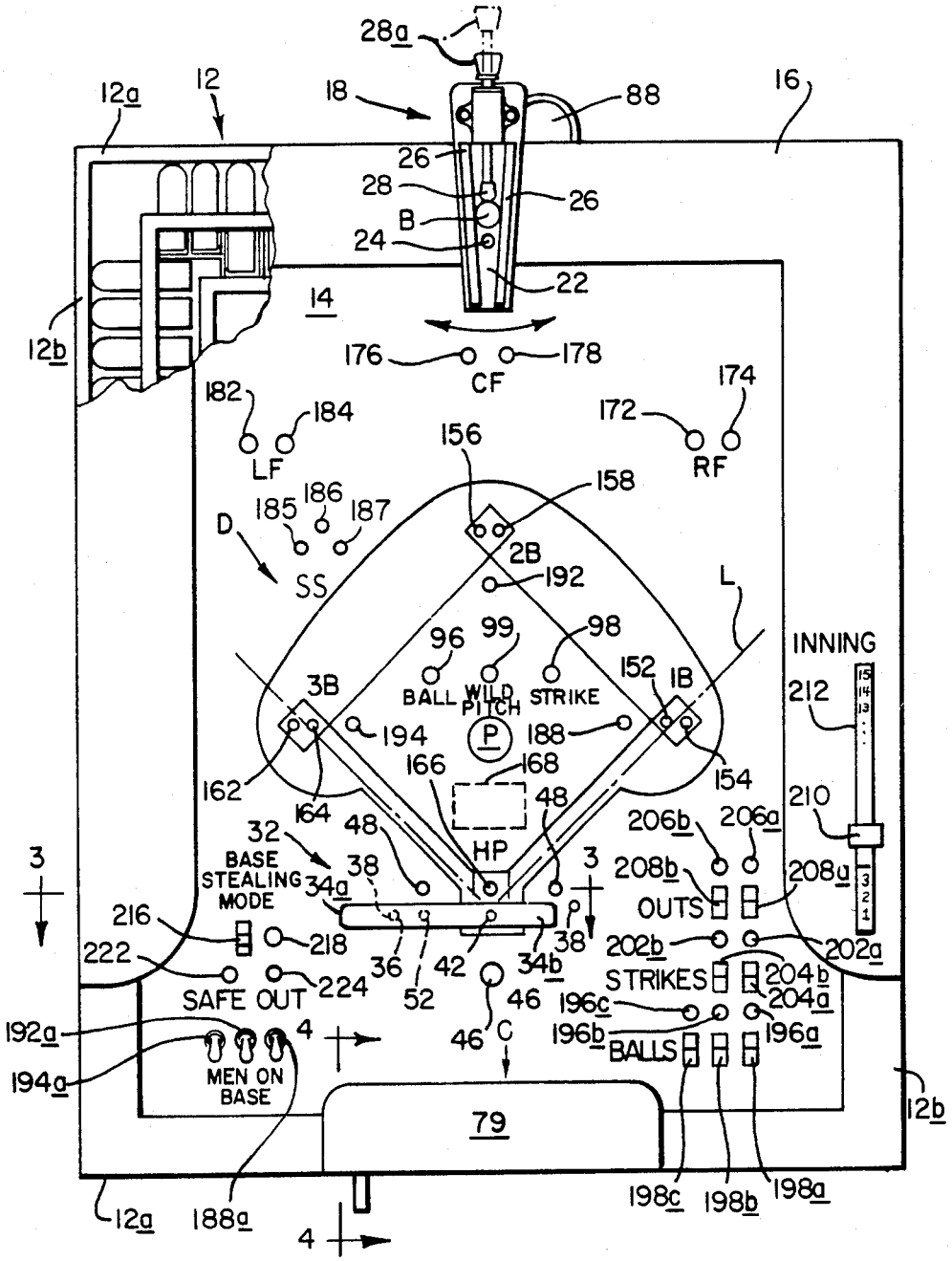
FIG. 1 is a top plan view with parts cut away of a simulated baseball game embodying the principles of this invention.
Figure 3:
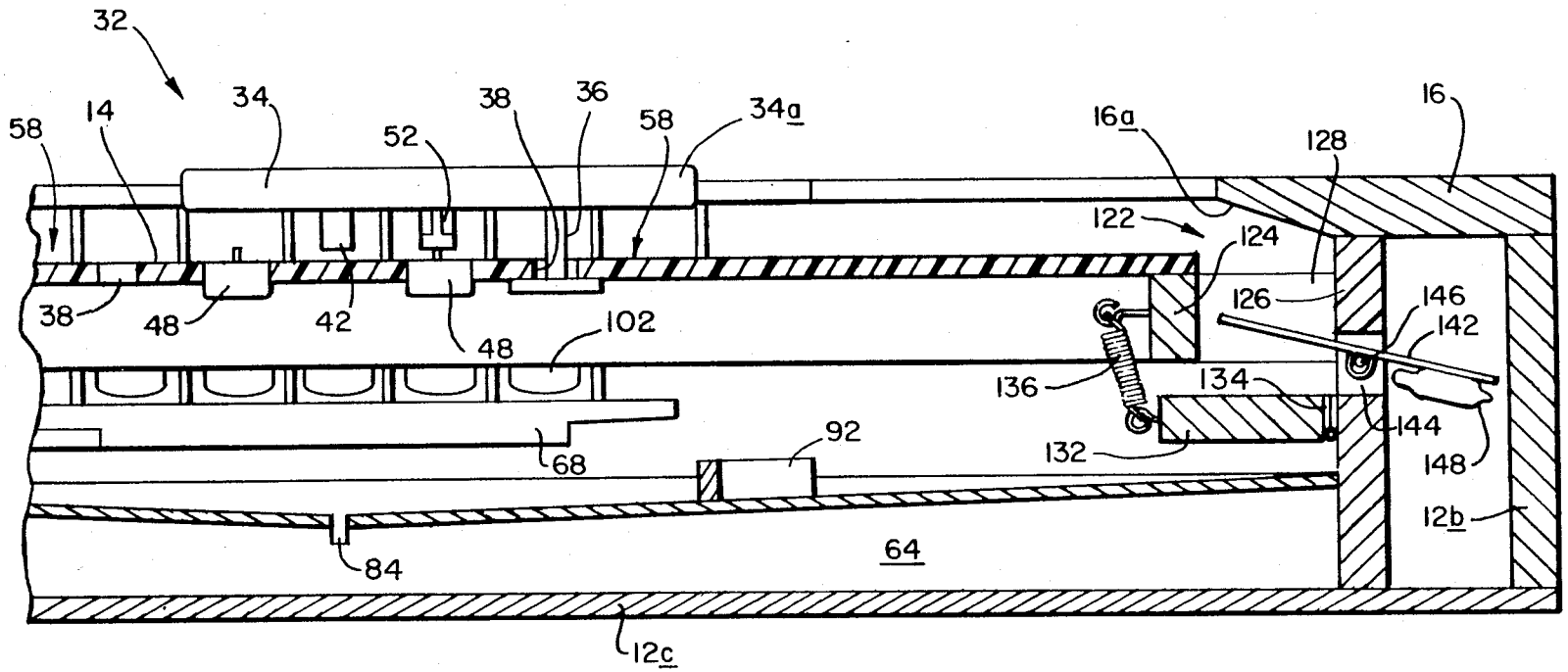
FIG. 3 is a sectional view along line 3—3 of FIG. 1.

Referring to FIGS. 1 and 3 of the drawings, the game includes a generally rectangular housing 12 having a pair of end walls 12*a*, a pair of side walls 12*b* and a bottom wall 12*c*. The housing side and end walls support a flat cover or top wall 14 which constitutes the game's playing surface. As best seen in FIG. 1, a conventional baseball playing field, including a printed diamond D, is laid out on surface 14. The diamond includes the usual bases (1B), (2B), (3B), and base lines (L), as well as a pitcher's mound (P) and a catcher location (C) behind home plate (HP). Also typical player positions at shortstop (SS), left field (LF), center field (CF) and right field (RF) are indicated on surface 14. A frame or border 16 mounted to the top of the housing side walls 12*b* and the outfield end wall 12*a* extends around the portion of the playing surface 14 beyond home plate.

Still referring to FIG. 1, the game includes a pitching mechanism shown generally at 18 mounted to frame 16 at a location which is in a direct line with the home plate and second base positions on diamond D. Mechanism 18 includes a flat tray 22 which is connected to the top of frame 16 by a pivot 24 and is arranged to support a small steel or plastic ball B. A pair of walls 26 are mounted to the top of tray 22 which converge at the end of the tray facing diamond D. The opposite end of the tray supports a conventional spring-loaded plunger 28. By retracting the plunger handle 28*a*, the plunger can be moved from its solid line position to its dotted line position illustrated in FIG. 1. When handle 28 is released, the plunger springs forward and propels the ball B from the tray in the direction that the tray is pointing at the time.

Thus, using handle 28*a*, the player in the field can retract the plunger and aim the tray so that, when the handle is released, the ball B will be propelled across surface 14 to the vicinity of home plate. Through practice, the player can pitch the ball directly across home plate or hit the inside or outside corners of the plate. He can even throw balls or intentionally walk a player if the occasion demands it. Indeed, he may even throw a wild pitch. And by retracting handle 28*a* different amounts and turning the handle, the player in the field can throw a fast ball, slow ball or curve.

Referring now to FIGS. 1 and 3, the game's batting mechanism, indicated generally at 32, is located directly behind home plate and comprises an elongated bat 34 made of wood or comparable resilient material. A pivot pin 36 extends at right angles from the bat at a location spaced adjacent one end 34*a* of the bat. That pin is arranged to be rotatively received within one of two sockets 38 located to the left of and to the right of home plate so that, by manipulating the bat end 34*a*, the player at bat can swing the opposite end 34*b* of the bat through the home plate area and thus hit a ball B projected across home plate by the pitching mechanism 18. As best seen in FIG. 3, the actual contact with the ball is made by a relatively narrow peg or striker 42 depending from the bat end 34*b*. That striker 42 is the only part of the batting mechanism that makes physical contact with the pitched ball and it has a width which is less than the diameter of ball B thus making it relatively difficult for the player at bat to hit the pitched ball forcefully enough to propel it back across the diamond D to the outfield.

FIG. 1 shows the bat 34 positioned in the left-hand socket 38 so that the bat is oriented for a left-handed hitter. When the player at bat is right-handed, the bat pivot pin 36 is positioned in the right-hand socket 38 so that the bat extends in the opposite direction across home plate. In either of these two positions, the player at bat can manipulate the bat handle 34*a* to swing at each ball pitched by the mechanism 18 operated by the player in the field.

In a preferred embodiment of this invention, provision is made for signaling when the player at bat has swung through or "broken his wrist" at each pitched ball. In the game specifically illustrated herein, a small lamp 46 is located directly behind home plate. This lamp is connected electrically to a power source (not shown) such as a battery or transformer contained in housing 12 and to a pair of parallel-connected microswitches 48 positioned at opposite sides of home plate. A small finger 52 projects down from bat 34 adjacent its pivot pin 36 and the switches 48 are positioned so that, when the player at bat has swung through at the ball, the finger 52 engages and closes one of the two switches 48, depending upon whether the bat is positioned for a left- or right-handed hitter, thereby turning on lamp 46. If the player at bat partially swings at a pitch which is outside the strike area, the indication given by lamp 46 determines whether the batter should be awarded a strike or a ball.

Figure 2:
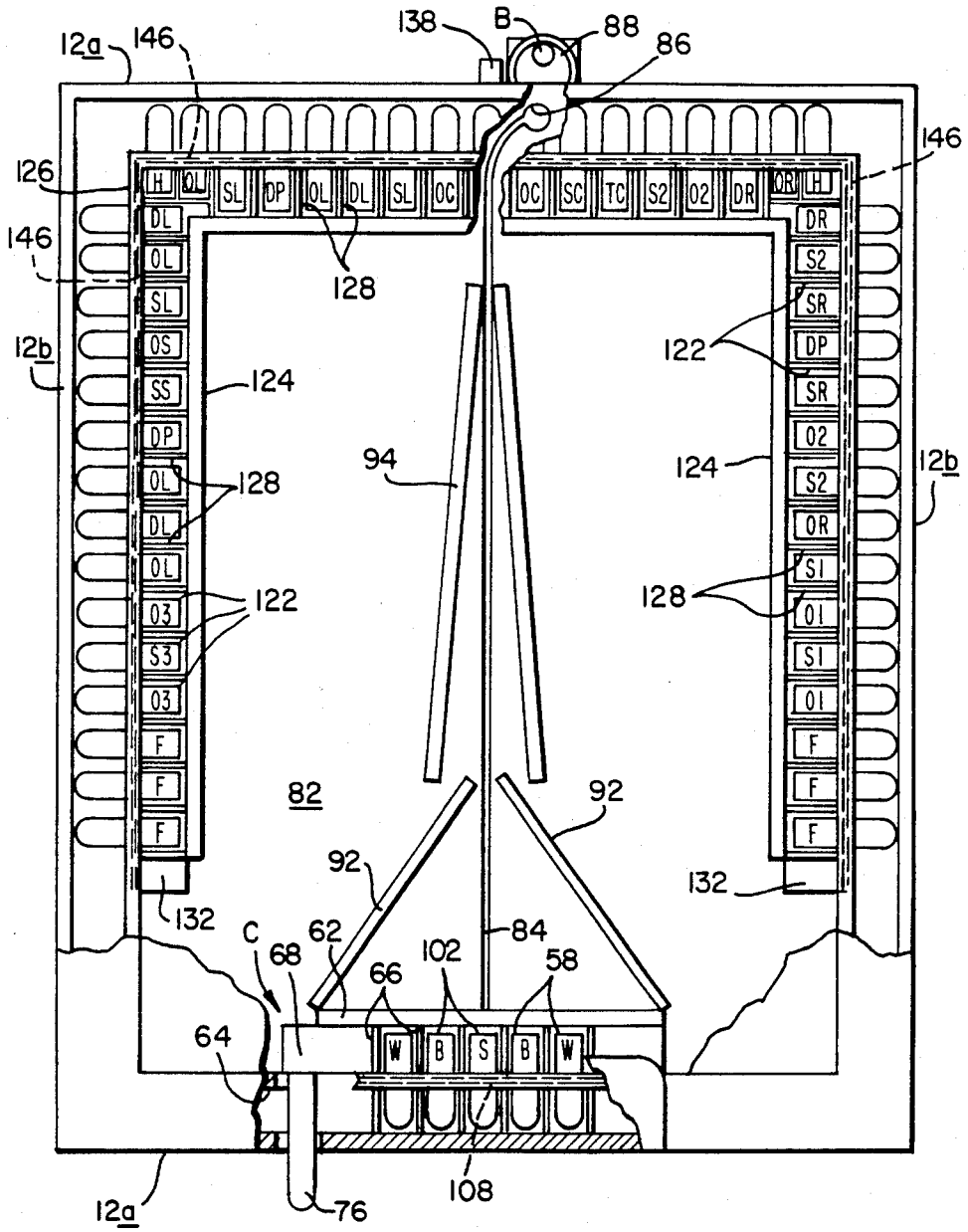
FIG. 2 is a similar view, but with the playing surface removed to expose internal components of the FIG. 1 game.
Figure 4:
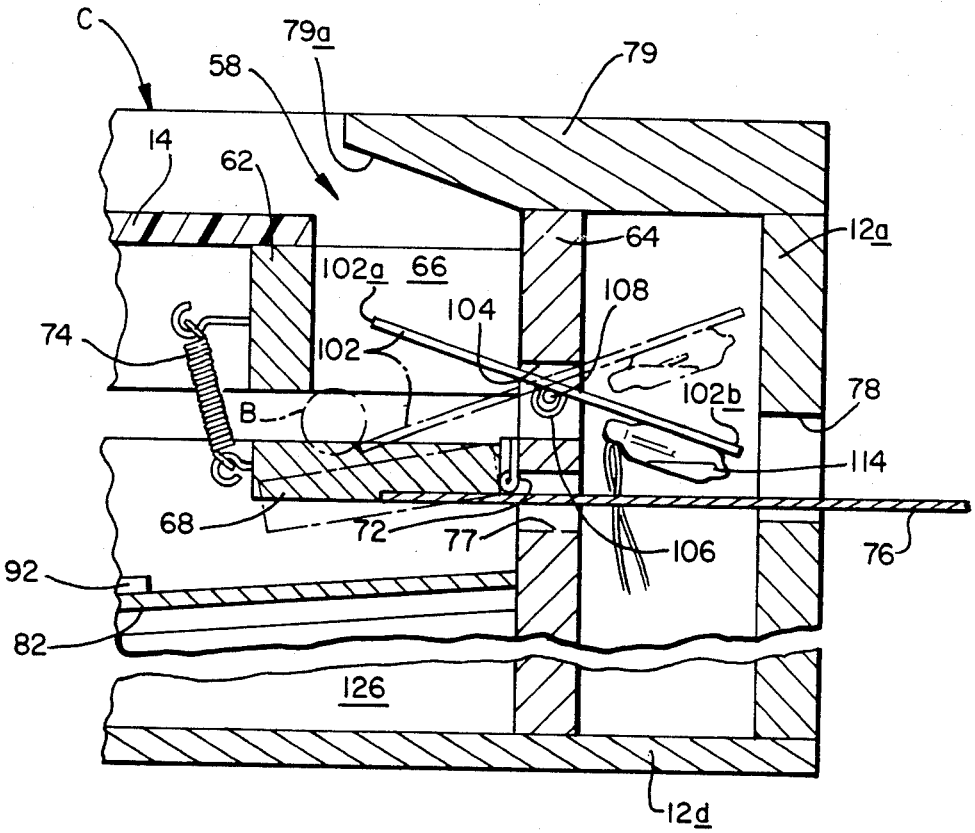
FIG. 4 is a sectional view along line 4—4 of FIG. 1.

Referring to FIGS. 1, 2 and 4, when the player at bat fails to hit the pitched ball, the ball continues on to a catching area shown generally at C. The catching area comprises a plurality of pockets 58 which extend below the playing surface 14 and whose entrances or mouths are flush with that surface. The pockets 58 have a common front wall 62, a common rear wall 64 and separate spaced-apart side walls 66, each pocket being large enough to receive the ball B. As best seen in FIG. 4, the pockets 58 also have a common movable bottom wall in the form of a trapdoor 68 which is connected by a hinge 72 to rear wall 64. The trapdoor is normally maintained in its elevated, i.e., closed, position by a spring 74 connected between the free edge of the trapdoor and wall 62. The door is swung down to its open position by the player at bat lifting a lever 76 affixed to the left-hand end of the trapdoor which projects out from through an opening 77 in wall 64 and an opening 78 in housing end wall 12*a* behind the catching area C. Thus, each pitched ball which is not hit by the batter lands in one of the pockets 58. To assure this, generally rectangular deflector 79 is mounted to the upper edge of the housing end wall behind pockets 58. This deflector has a beveled undersurface 79*a* which directs the incoming pitched ball into one or another of the pockets.

After each pitch, the player at bat lifts handle 76 which opens the trapdoor 68 so that the ball drops out of the pocket into which it was pitched. The housing 12 contains a concave inner wall 82 onto which the ball drops. The surface of wall 82 slopes or declines from the opposite side edges of that wall to a long slot 84 extending along the longitudinal centerline of wall 82. Also, as best seen in FIGS. 2 and 4, the surface of wall 82 slopes downwardly from the catching area C to the housing end wall 12*a* in center field. Slot 84 is narrower than the diameter of ball B so that, once the ball is conducted to the slot, it rolls down that slot to a hole 86 in wall 82 through which the ball drops into a tray 88 which projects beyond the housing wall 12*a* at the outfield end of the housing. The ball can then be retrieved by the player in the field and placed in the pitching mechanism 18 in preparation for the next pitch.

As shown in FIG. 2, a pair of ribs 92 project up from wall 82 in front of pockets 58. The ribs are toed in toward slot 84 to help conduct the ball released from the pockets to slot 84. A second pair of toed-in ribs 94 projecting up from wall 82 ahead of ribs 92 also help to ensure that, when the ball B is dropped onto the surface of wall 82 at any point on that surface, it rolls to slot 84 so that it is eventually returned to tray 88.

Referring to FIGS. 1 and 4, when the pitched ball is received in one of the pockets 58, a signal is emitted which apprises the players whether the ball-receiving pocket is designated for a strike (S) or a ball (B) or a wild pitch (W). More particularly, a red lamp 96, a white lamp 98 and a blue lamp 99 are positioned on the playing surface 14 adjacent the pitcher's mound P. When lit, lamp 96 designates a ball, lamp 98 signals a strike and lamp 99 designates a wild pitch. Lamp 96 is connected in parallel to the switches in the second and fourth pockets 58 marked (B) so that when the ball drops into one of those pockets, the associated switch is closed and lamp 96 is turned on signaling a ball. Lamp 98 is connected to the switch in the middle pocket 58 (marked S) so that that lamp is turned on when the ball drops into one of those three pockets marked for a strike.

The first and fifth pockets 58 are designated W for a wild pitch and each contains a switch, which turns on lamp 99 when the ball falls into one of these pockets. Upon the occurrence of a wild pitch, any player on base advances to the next base.

As best seen in FIG. 4, the switch in each pocket comprises a lever 102 which extends through an opening 104 in wall 64 at the rear of each pocket 58 and above the trapdoor 68. Each lever 102 is swingably connected by a staple 106 to a rod 108 which extends along wall 64 through registering holes in the side walls of openings 104. Each lever 102 is positioned so that one end 102*a* projects into the associated pocket 58 so that it is engaged and depressed by a ball B dropping into that pocket. The opposite end 102*b* of the lever projects into the space between wall 64 and the adjacent housing wall 12*a*. Supported from each lever end 102*b* is a conventional mercury switch 114 which is connected as described above to lamp 96, 98 or 99 and the power source. Each lever 102 is normally weighted by switch 114 so that it reposes in its solid line position shown in FIG. 4 with the switch 114 then being in its off or open condition. When a ball B drops into the associated pocket, the ball lands on the lever end 102*a* in that pocket and swings the lever to its dotted line position shown in FIG. 4 so that contact is made in switch 114 with the result that the associated lamp 96, 98 or 99 is illuminated signaling a ball, a strike or a wild pitch.

Referring now to FIGS. 2 and 3, if the player at bat hits a pitched ball, the ball travels across the playing surface 14 and is received in one of a multiplicity of ball-receiving pockets 122 disposed around playing surface 14 under frame 16. The game specifically illustrated herein has seventeen such pockets 122 disposed along the housing wall 12*a* in the outfield and fifteen such pockets on each side of the playing field forward of the catching position. Of course, there could be more or fewer such pockets depending upon the size of the game board and the number of play options desired.

Pockets 122 are substantially identical to pockets 58 described above and the ball B is deflected into the pockets by the beveled undersurface 16*a* of frame 16. Thus, each row of pockets is defined by an inner wall 124, an outer wall 126 and a series of spaced-apart side walls 128 which separate the pockets. Each of the three rows of pockets has a separate trapdoor 132 connected by a hinge 134 to wall 126 and each door is biased to its closed position by a spring 136 extending between the free edge of the trapdoor and wall 124. The opposite ends of the trapdoor 132 which extends along wall 12*a* at the outfield end of the housing overlap the adjacent ends of the doors 132 which extends along the sides of the playing field. Consequently, when that end door is swung down, it pushes the two doors at the sides of the housing down as well. The end trapdoor is swung down by a lever 138 connected to that door and which projects out from housing 12 adjacent tray 88 as shown in FIG. 2. Thus, by lifting lever 138, the player in the field can open the three trapdoors 132 all at the same time so that, no matter which pocket 122 contains the ball, the ball will drop from that pocket onto the concave surface of wall 82 and be conducted to the return slot 84 and thence to tray 88 as described above.

Each pocket 122 also contains a switch identical to the switches in pockets 58. That is, each pocket contains a lever 142 which projects through an opening 144 in wall 126 at the rear of that pocket. The levers 142 in each row of pockets are swingably connected to a rod 146 which extends along wall 126 and the outboard end of each lever 142 carries a mercury switch 148 which is identical to switch 114. The various switches 148 remain open until the associated levers 122 are depressed by the ball B entering the corresponding pockets.

The pockets 122 are designated for various hit, out and other play possibilities prevalent in the real game of baseball. The switches in the various pockets are connected electrically to a power source and to one or another of a multiplicity of indicator lamps positioned at various locations on the playing surface 114 which correspond with the particular hit or out possibilities marked on the pockets. As shown in FIG. 2, these various play possibilities include the following:

| | |
|---|---|
| foul ball (F) | single to left field (SL) |
| out at first base (O1) | double to left field (DL) |
| single to first base (S1) | out at left field (OL) |
| out at second base (O2) | single to center field (SC) |
| single to second base (S2) | triple to center field (TC) |
| out at right field (OR) | out at center field (OC) |
| single to right field (SR) | single to third base (S3) |
| double to right field (DR) | out at third base (O3) |

-continued

| | |
|---|---|
| home run (H) | out at shortstop (OS) |
| | double play (DP) |

Thus, as shown in FIGS. 1 and 2, when the ball lands in a pocket designated S1, indicating a hit to first base, a white lamp 152 at first base is turned on. On the other hand, if ball B lands in an out-at-first-base pocket (01), a red lamp 154 at first base is illuminated signaling the out. Similar white and red lamps 156 and 158 at second base are illuminated upon the occurrence of a hit and an out at that location when the ball B lands in the corresponding pockets 122 marked (S2) and (02). Likewise, white and red lights 162 and 164 are located at third base to signal the hits and outs made at that location when the ball is hit to the pockets 122 marked (S3) and (03). A single white lamp 166 is located at home plate which is illuminated when the ball B lands in a pocket 122 designated for a home run (H). Also, to give that event greater emphasis, a buzzer 168 (FIG. 1) mounted to the underside of surface 14 can be sounded by the same switch that turns on lamp 166.

Similar lamps signaling hits and outs are spotted at the various player locations in the outfield. Thus, white and red hit and out lamps 172 and 174 are located in right field, similar lamps 176 and 178 are placed in center field and comparable lights 182 and 184 are situated in left field. Those lamps are illuminated when the ball lands in the pockets 122 designated for hits (i.e., singles, doubles or triples) and for outs at those locations. White and red hit and out lamps 185 and 186 are also positioned at the shortstop location (SS). An additional blue lamp 187 there signals a double play in the event that the ball B lands in a pocket 122 designated as a double play (DP) pocket.

Men on base are indicated by white lamps 188, 192 and 194 situated on surface 14 just inboard of first, second and third base respectively. These lamps are turned on manually by the player at the bat manipulating the three switches 188*a*, 192*a* and 194*a* located to the left of the catching area C.

More or less regular baseball rules apply to my simulated game. Whenever the batter makes a single, double or triple, the lamp 188, 192 or 194 is turned on. If the batter gets a hit, the men on base are advanced the same number of bases as the batter. That is, if there is a man on first base and the batter hits a double, the man on first base advances to third base. On the other hand, if that man had been on second base when the double occurred, then he would score. When a double play is signaled by the illumination of lamp 186, the two most advanced runners on base (if any) are deemed out.

As shown in FIG. 1, the game includes provision for keeping track of balls, strikes and outs as an umpire would do. More particularly, positioned on the playing surface 14 to the right of the catching area C are three lamps 196*a*, 196*b* and 196*c* which are controlled manually by the player at bat actuating switches 198*a*, 198*b* and 198*c* respectively. The number of strikes for a given batter are indicated by lamps 202*a* and 202*b* controlled by switches 204*a* and 204*b* respectively. The number of outs in a particular inning are indicated by lamps 206*a* and 206*b* controlled by switches 208*a* and 208*b* respectively. The players can also keep track of the innings in the game by moving a slider 210 along an appropriately marked scale 212 mounted to frame 16 at the right-hand side of the housing.

In order to maximize the interest generated by the present simulated baseball game, the game can be operated in a so-called base-stealing mode by the player at bat closing a switch 216. When that switch is closed, an indicator lamp 218 is turned on signaling that the game is being operated in its base-stealing mode. The closing of that switch also effectively changes the designations of some of the pockets 122 to so-called stolen base pockets by connecting the switches in those pockets to one or the other of a white lamp 222 and a red lamp 224 which indicate that a player is safe or out in a base-stealing situation.

In accordance with the rules of the game, when the game is operating in its base-stealing mode and the batter hits the ball B to a pocket now designated as a stolen-base-safe, pocket (SBS), any runner on base advances to the next base and the batter remains at bat as though he had not hit the ball. On the other hand, if the batter hits the ball into a stolen-base-out pocket (SBO), the lead man on base is deemed out and the batter remains at bat. Also, in a situation where there is a man on base and the batter hits the ball to a pocket 122 designating an out at that base, the man on that base is deemed caught off base and called out and the batter remains at bat. Thus, in these base-stealing situations, although the player at bat hits the ball into one of the pockets 122, no hit or out is assessed against him.

It is important to note from FIG. 2 that many of the assignments of the play or fielding designations for the ball-receiving pockets 122 correspond to situations that result when the ball is batted in those directions in a real baseball game. Thus, by far the majority of the pockets designating hits and outs to left field are located in the left field section of the playing surface 14. Similarly, the pockets 122 designating singles and outs at first base are located behind the first base territory. The pockets designated as foul are obviously located in foul territory behind first base and third base. Pockets designated as double play, out at second base and double are randomly inserted among the directionally assigned fielding designations and home run pockets are intentionally placed in the corners of the outfield because those are the most difficult pockets for the batted ball to reach.

It is a further feature of this game that, within each field sector, the total number of designations corresponding to outs are more or less equal in number to the designations corresponding to hits. Also, the frequencies of the various designations in the game vary as hits and outs at the various field locations in an actual game of baseball.

It should be apparent from the foregoing also that the present game can include other game possibilities such as hits and outs to the pitcher, pop fouls to the catcher, triple plays, etc. Also, the various manually controlled lights which signal balls, strikes and outs as well as men on base, can be controlled by an appropriate microprocessor in housing 12 so that the balls, strikes and outs are accumulated automatically and the base runners advanced automatically. Likewise, if desired, the ball return can be accomplished automatically by appropriate processor-controlled solenoids operating the various trapdoors.

It will be seen from the foregoing, then, that my game requires a certain amount of skill on the parts of the pitcher and batter. Also, the game accounts for many, if not most, of the playing situations found in an actual game of baseball. Therefore, it should hold the players' interests for a considerable period of time. Despite these advantages, the game is simple to operate so that it can be played by players of all ages having a rudimentary knowledge of the game of baseball.

It will thus be seen that the objects set forth above, among those made apparent from the preceding description, are efficiently attained, and, since certain changes may be made in the above construction without departing from the scope of the invention, it is intended that all matter contained in the above description or shown in the accompanying drawings be interpreted as illustrative and not in a limiting sense.

It is also to be understood that the following claims are intended to cover all of the generic and specific features of the invention herein described.

I claim:

1. A simulated baseball game comprising:

A. a housing including a flat upper wall and a lower wall;

B. indicia on said upper wall representing a baseball field including the usual diamond and outfield locations;

C. ball pitching means mounted to said housing for pitching a small ball across said upper wall toward the home plate area thereon;

D. batting means movably mounted to said upper wall adjacent the home plate area for swinging at a pitched ball, said batting means including:

(1) a miniature bat, (2) a pivot pin projecting at right angles from a location adjacent one end of said bat, (3) first and second pin-receiving sockets formed in said upper wall at locations spaced on opposite sides of home plate so that the bat can be swung from left- and right-handed positions across home plate by inserting the pivot pin in one or the other of said sockets, and (4) "broken wrist" signalling means for signalling when said bat has been swung through a selected minimum angle; and E. a first set of pockets formed side by side in said upper wall behind home plate for receiving a pitched ball that is not hit by the batting means, at least one said pocket located directly behind home plate being a strike-designating pocket, and pockets on opposite sides of said strike-designating pocket being ball-designating pockets;

F. a second set of ball-receiving pockets formed in said upper wall around the perimeter of said outfield, different ones of said pockets in the various outfield sectors being designated for the usual hit and run situations that occur at the fielding positions within those sectors during an actual game of baseball; and G. means for signalling when a pitched ball is received in one or another of said pockets.

2. The game defined in claim 1 wherein the said "broken wrist" signalling means comprise:

A. first and second switch means mounted in said upper wall at locations spaced on opposite sides of home plate;

B. means projecting from said bat for actuating said first or second switch means when said bat is swung at one of said sockets through said selected minimum angle;

C. a power source in said housing; and

D. a lamp mounted to said housing and connected electrically to said power source and said first and second switch means so that when said first or second switch means are actuated, said lamp is illuminated.

3. A simulated baseball game comprising:

A. a housing including a flat upper wall and a lower wall;

B. indicia on said upper wall representing a baseball field including the usual diamond and outfield locations;

C. ball pitching means mounted to said housing for pitching a small ball across said upper wall toward the home plate area thereon;

D. batting means movably mounted to said upper wall adjacent the home plate area for swinging at a pitched ball;

E. a first set of pockets formed side by side in said upper wall behind home plate for receiving a pitched ball that is not hit by the batting means, at least one said pocket located directly behind home plate being a strike-designating pocket, and pockets on opposite sides of said strike-designating pocket being ball-designating pockets;

F. a second set of ball-receiving pockets formed in said upper wall around the perimeter of said outfield, different ones of said pockets in the various outfield sectors being designated for the usual hit and run situations that occur at the fielding positions within those sectors during an actual game of baseball; and G. means for signalling when a pitched ball is received in one or another of said pockets, said signalling means comprising:

(1) a first set of switches located in said first set of pockets, each switch of the first set being actuated when a ball is received in the corresponding pocket of the first set;

(2) a power source;

(3) a first signal lamp connected electrically to said power source and the switches in the strike-designating pockets of said first set; and (4) a second signal lamp connected electrically to said power source and to the switches in the ball-designating pockets of said first set so that when a ball is received in one of the pockets of the first set, the lamp corresponding to the designation of that pocket is illuminated.

(5) a second set of switches located in said second set of pockets, each switch of the second set being actuated when a ball is received in the corresponding pocket of the second set;

(6) a first set of hit-designating signal lamps mounted to said upper wall at locations thereon corresponding to the field positions of the hit-designating pockets of said second set;

(7) a second set of signal lamps mounted to said upper wall at locations thereon corresponding to the field positions of the out-designating pockets of said second set;

(8) first means for electrically connecting the first set of signal lamps to the switches in the hit-designating pockets of said second set; and (9) second means for electrically connecting the second set of signal lamps to the switches in the out-designating pockets of the second set so that when a ball is received in one or another of the pockets of the second set, the signal lamp corresponding to the designation of that pocket is illuminated signalling a hit or an out to the designated field position;

H. one or more stolen base-indicating lamps mounted to said upper wall; and

I. switch means mounted to said housing for disconnecting the switches in selected ones of the pockets of the second set from their associated signal lamps and connecting those switches to said one or more stolen base-indicating lamps thereby to effectively change the designation of said selected pockets to indicate that a man on base has stolen a base or has been caught off base.

4. A simulated baseball game comprising:

A. a housing including a flat upper wall and a lower wall;

B. indicia on said upper wall representing a baseball field including the usual diamond and outfield locations;

C. ball pitching means mounted to said housing for pitching a small ball across said upper wall toward the home plate area thereon;

D. batting means movably mounted to said upper wall adjacent the home plate area for swinging at a pitched ball;

E. a first set of pockets formed side by side in said upper wall behind home plate for receiving a pitched ball that is not hit by the batting means, at least one said pocket located directly behind home plate being a strike-designating pocket, and pockets on opposite sides of said strike-designating pocket being ball-designating pockets;

F. a second set of ball-receiving pockets formed in said upper wall around the perimeter of said outfield, different ones of said pockets in the various outfield sectors being designated for the usual hit and run situations that occur at the fielding positions within those sectors during an actual game of baseball;

G. means for signalling when a pitched ball is received in one or another of said pockets;

H. means for releasing a ball received in said pockets so that the ball so that the ball drops toward said lower wall, said releasing means comprising (1) first trapdoor means movably mounted to said housing at the underside of said first set of pockets and movable between a closed position wherein the first trapdoor means form the bottoms of the pockets of said first set and an open position wherein said first trapdoor means expose the pockets of said first set from below permitting a ball therein to drop onto said lower wall, (2) means for biasing said first trapdoor means to said closed position, (3) means enabling a player to move the first trapdoor means to said open position, (4) second trapdoor means movably mounted to said housing at the underside of said second set of pockets and movable between a closed position wherein the second trapdoor means form the bottoms of the pockets of said second set an open position wherein the second trapdoor means expose the pockets of said second set from below permitting the ball therein to drop onto said lower wall, (5) means for biasing the second trapdoor means toward said closed position, and (6) means enabling a player to move the second trapdoor means to said open position; and I. means for conducting a released ball dropped onto said lower wall to a ball-return location adjacent said ball pitching means, said conducting means comprising (1) upper surface portions which decline longitudinally from an upper location under home plate to a lower location under said pitching means, (2) a longitudinal slot on said upper surface portions, extending along a centerline from under home plate to under said pitching means, said slot being narrower than said ball, (3) said upper surface portions also declining horizontally from second upper locations under said second set of ball-receiving pockets located on opposite sides of the outfield to the longitudinal slot, (4) a first pair of ribs projecting up from said upper surface portions in front of said first set of pockets and toed-in toward said slot to help conduct the ball released from the first set of pockets to the slot, (5) a second pair of toed-in ribs projecting up from said upper surface portions, ahead of said first set of ribs, to guide the ball released from the second set of pockets along the rib toward the lower end of the slot, and (6) a ball receiving tray mounted to said housing adjacent said pitching means, said tray being in communication with said wall upper surface portions so that a ball dropped onto said lower wall is conducted by gravity to said tray.

* * * * *